US008110789B2

(12) United States Patent
Pei

(10) Patent No.: US 8,110,789 B2
(45) Date of Patent: Feb. 7, 2012

(54) ELECTRONIC DEVICE AND METHOD FOR RECORDING DISASSEMBLY TIMES THEREOF

(75) Inventor: Guang-Yu Pei, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 396 days.

(21) Appl. No.: 12/503,859

(22) Filed: Jul. 16, 2009

(65) Prior Publication Data

US 2010/0038524 A1 Feb. 18, 2010

(30) Foreign Application Priority Data

Aug. 15, 2008 (CN) ..... 2008 1 0303859

(51) Int. Cl.
*H01J 40/14* (2006.01)
*G08B 13/18* (2006.01)

(52) U.S. Cl. ..... 250/222.1; 340/555

(58) Field of Classification Search ..... 250/221, 250/222.1; 340/552, 555, 556, 557
See application file for complete search history.

(56) References Cited

U.S. PATENT DOCUMENTS

| | | | | |
|---|---|---|---|---|
| 5,415,641 | A * | 5/1995 | Yerlikaya et al. | 604/251 |
| 5,808,296 | A * | 9/1998 | McMonagle et al. | 250/221 |
| 6,255,946 | B1 * | 7/2001 | Kim | 340/556 |
| 6,581,392 | B1 * | 6/2003 | Gist et al. | 62/66 |
| 6,642,846 | B1 * | 11/2003 | Krubiner et al. | 340/545.3 |
| 2003/0099158 | A1 * | 5/2003 | De la Huerga | 368/10 |
| 2007/0085677 | A1 * | 4/2007 | Neff et al. | 340/539.22 |
| 2007/0164857 | A1 * | 7/2007 | Odenwald et al. | 340/539.22 |
| 2008/0237485 | A1 * | 10/2008 | Beinhocker | 250/474.1 |
| 2009/0102660 | A1 * | 4/2009 | Evans et al. | 340/572.1 |
| 2010/0038524 | A1 * | 2/2010 | Pei | 250/222.1 |

* cited by examiner

*Primary Examiner* — John Lee
(74) *Attorney, Agent, or Firm* — Altis Law Group, Inc.

(57) ABSTRACT

An electronic includes a memory, a photosensitive element, and a processing element. The photosensitive element receives light beams and generating trigger signals when intensity of the received light beams reach a predetermined value. The processing element electrically connected to the photosensitive element and the memory, counts a number of disassembly times of the electronic device according to the times the trigger signals have been generated by the photosensitive element and stores the number in the memory.

4 Claims, 6 Drawing Sheets

ELECTRONIC DEVICE AND METHOD FOR RECORDING DISASSEMBLY TIMES THEREOF

BACKGROUND

1. Technical Field

The disclosure relates to an electronic device and a method for recording disassembly times thereof.

2. Description of Related Art

When deciding whether to purchase a particular electronic device in a marketplace, people may check if the electronic device has been opened for service or repair by inspecting a seal on the electronic device. However, this can only alert people to the fact of whether it has been opened and not how many times it has been opened. Therefore, what is needed is an electronic device and method for recording the number of times an electronic device has been opened to solve the above-mentioned problem.

BRIEF DESCRIPTION OF THE DRAWINGS

The components of the drawings are not necessarily drawn to scale, the emphasis instead being placed upon clearly illustrating the principles of an electronic device. Moreover, in the drawings, like reference numerals designate corresponding parts throughout several views.

DETAILED DESCRIPTION

Figure 1:
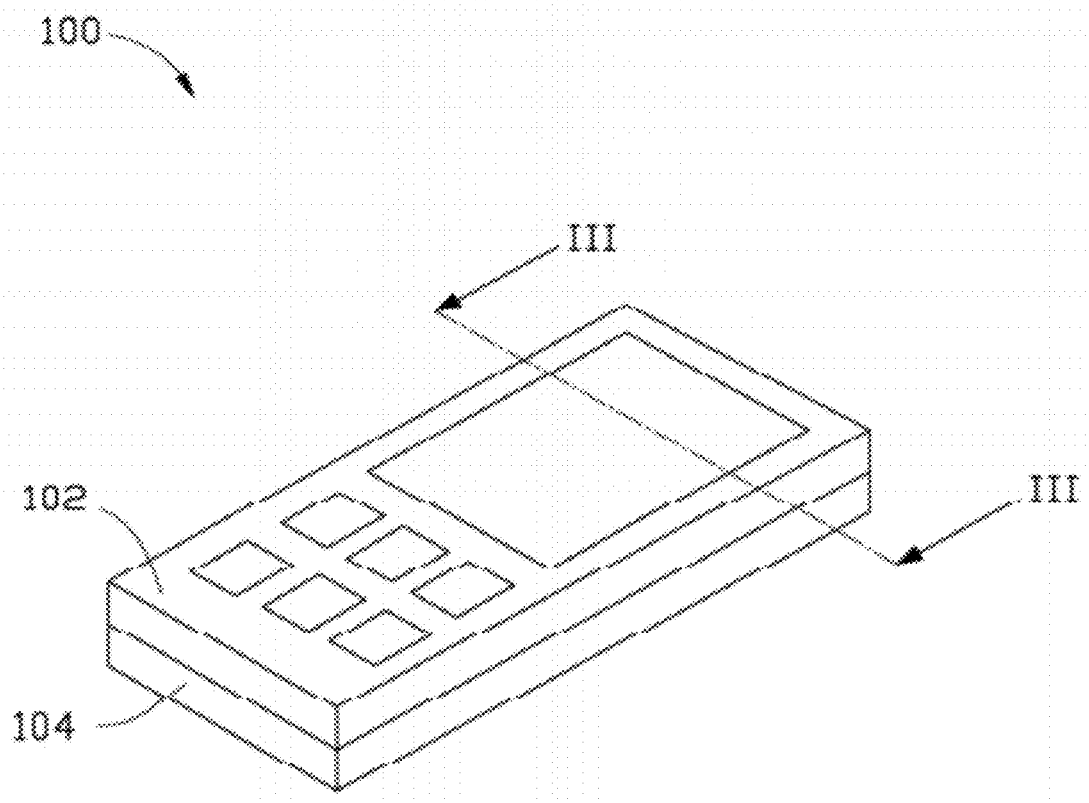
FIG. 1 is a schematic, isometric view of an electronic device in accordance with one embodiment.
Figure 2:
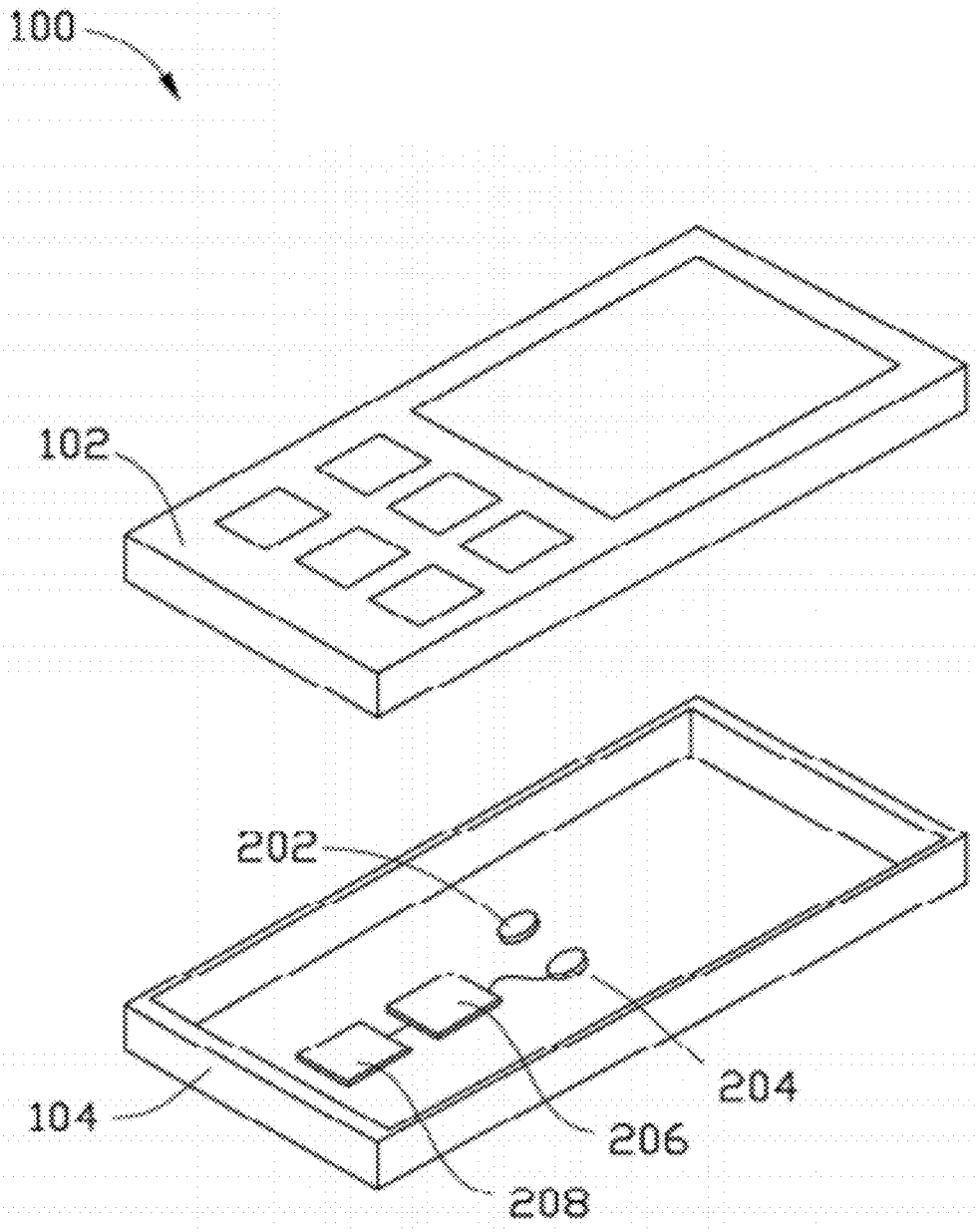
FIG. 2 is a disassembled view of the electronic device shown in FIG. 1.
Figure 3:
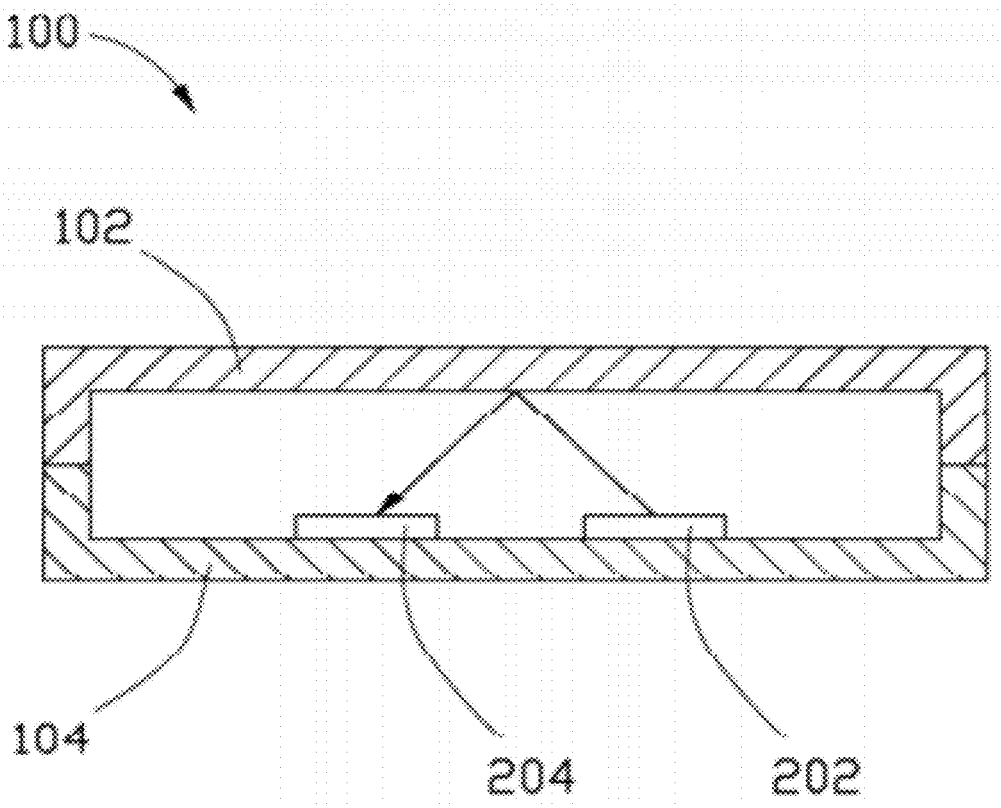
FIG. 3 is a cross-sectional view of the electronic device of FIG. 1, taken along the line III-III in FIG. 1.

Referring to FIGS. 1 to 3. An electronic device 100 includes a front cover 102 and a rear cover 104. The electronic device 100 further includes an illuminating element 202, a photosensitive element 204, a processing element 206, and a memory 208.

The illuminating element 202, mounted on the inner surface of the rear cover 104, is configured to emit light beams having a specific wavelength, such as infrared. The light beams emitted by the illuminating element 202 are reflected by the inner surface of the front cover 102 to the photosensitive element 204. The illuminating element 202 emits light beams at a predetermined frequency, for example, every 15 seconds. The illuminating element 202 can also be mounted on the inner surface of the front cover 102 aligned with the photosensitive element 204, accordingly, the light beams emitted by the illuminating element 202 reach the photosensitive element 204 directly.

The photosensitive element 204 is configured to receive the light beams emitted by the illuminating element 202, and generate a trigger signal when the intensity of the received light beams reaches a predetermined value. In the embodiment, the photosensitive element 204 generates a trigger signal when the intensity of the received light beams becomes the same as or lower than a predetermined value T1. Referring to FIG. 3, when the front cover 102 is covered on the rear cover 104, the photosensitive element 204 receives the light beams reflected by the inner surface of the front cover 102. When the electronic device 100 is disassembled, that is, the front cover 102 is moved from the rear cover 104, the light beams emitted by the illuminating element 202 cannot reach the photosensitive element 204, accordingly, the photosensitive element 204 generates a trigger signal, and the trigger signal indicates that the front cover 102 has been removed.

The processing element 206, electrically connected to the memory 208 and the photosensitive element 204, is configured to count a number of disassembly times of the electronic device 100 according to the trigger signals generated by the photosensitive element 204 and store the number of disassembly times into the memory 208. Especially, the processing element 206 increments the number of disassembly times by one when receiving a trigger signal from the photosensitive element 204.

Figure 4:
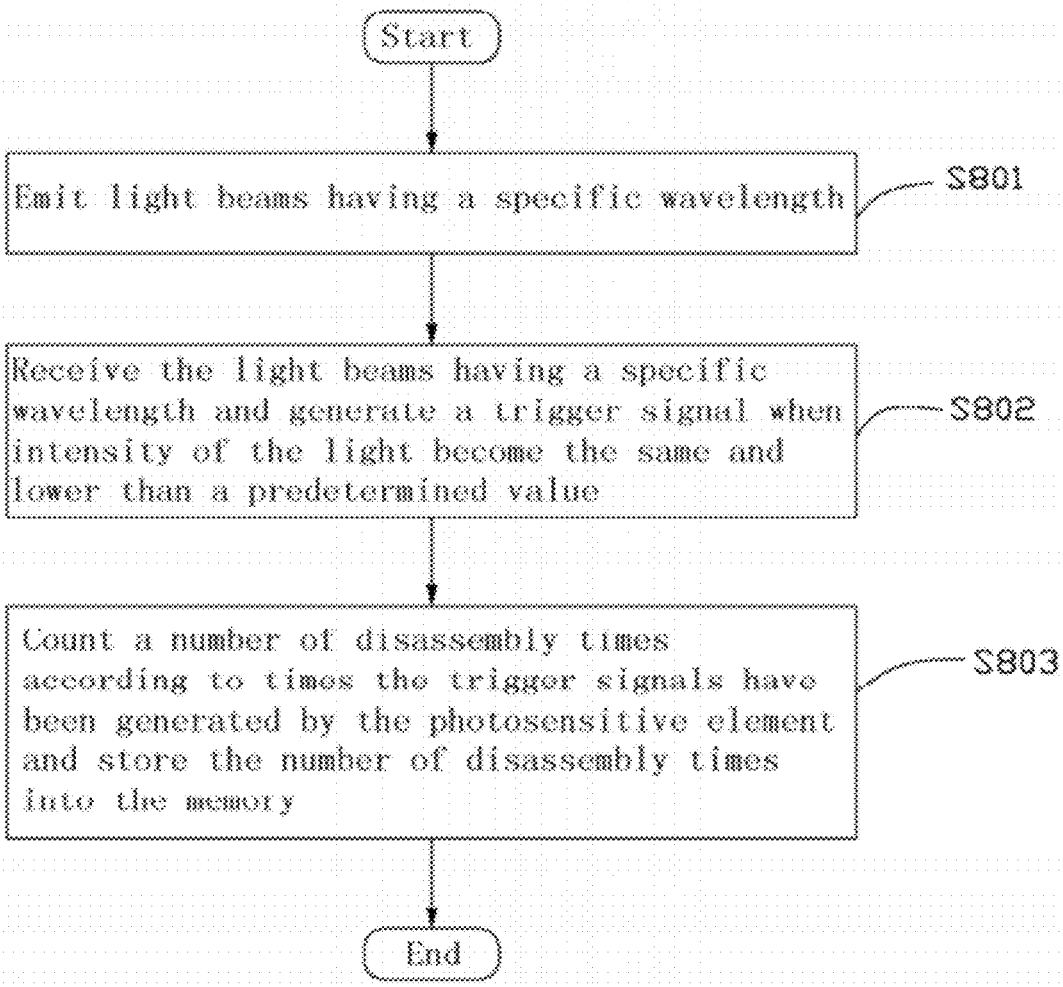
FIG. 4 is a flowchart for a method of recording disassembly times of an electronic device in accordance with an embodiment.

FIG. 4 is a flowchart for a method of recording disassembly times of the electronic device in accordance with an embodiment. In step S801, the illuminating element 204 emits light beams having a specific wavelength.

In step S802, the photosensitive element 204 receives the light beams emitted from the illuminating element 202, and generates a trigger signal while the intensity of the received lights become the same and lower than a predetermined value.

In step S803, the processing element 206 counts a number of disassembly times of the electronic device 100 according to the times the trigger signals have been generated by the photosensitive element 204 and stores the number of disassembly times into the memory 208.

People can easily retrieve the disassembly times stored in the memory 208 and know whether or not and how many times the electronic device 100 had been opened up. For example, the electronic device can be connected to a computer via USB, and people can retrieve the disassembly times information.

Figure 5:
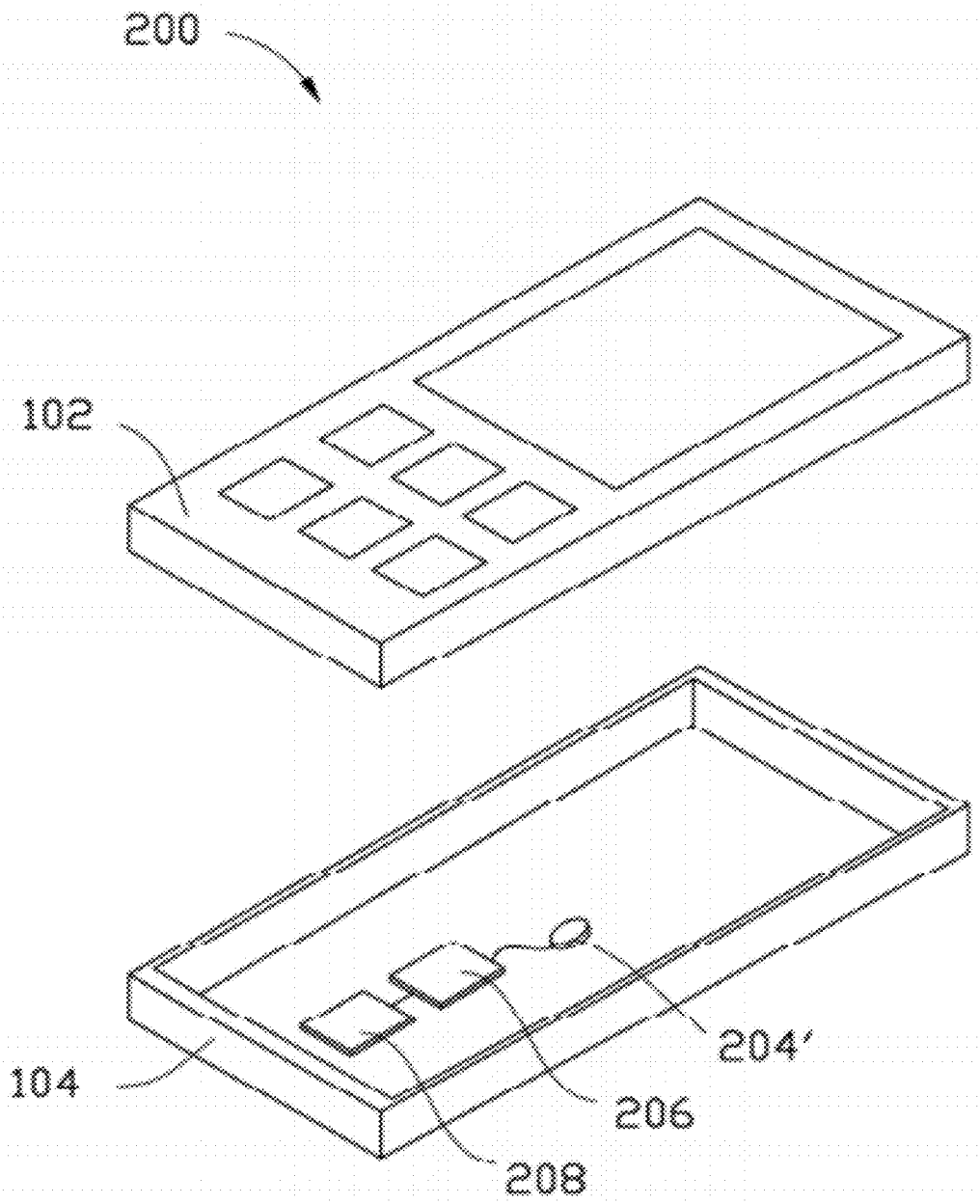
FIG. 5 is a disassembled view of an electronic device in another embodiment.

Referring to FIG. 5, another electronic device 200 is disclosed. Compared to the electronic device 100 of FIG. 1, the electronic device 200 has no illuminating element 202 and the photosensitive element 204 is configured to detect the intensity of the ambient light inside the electronic device 200, and generates a trigger signal when the intensity of the ambient light reaches a predetermined value. In the embodiment, the photosensitive element 204 generates a trigger signal when the intensity of the ambient light exceeds a value T2, which would happen when the electronic device 200 is opened up.

Figure 6:
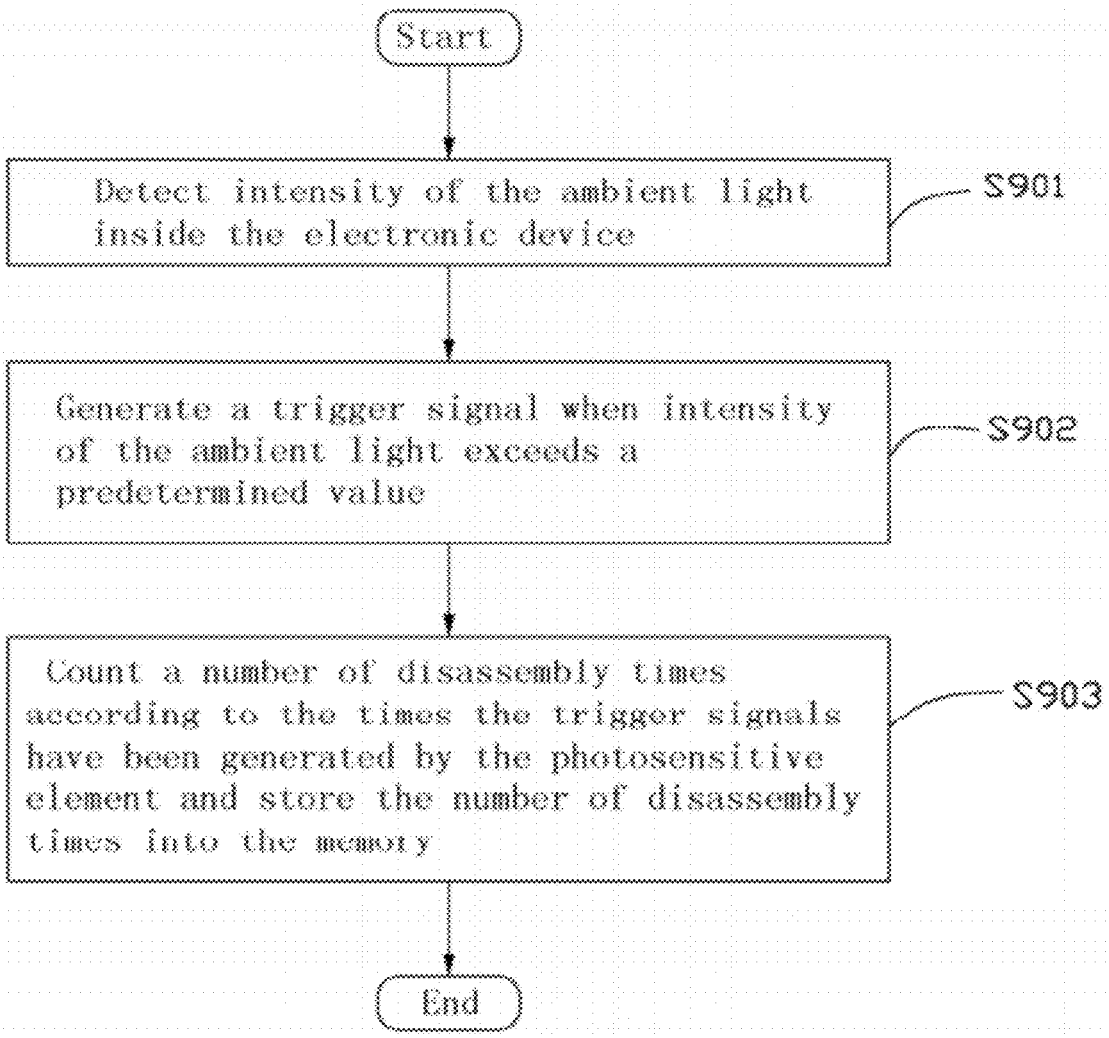
FIG. 6 is a flowchart for a method of recording disassembly times of an electronic device in accordance with another embodiment.

FIG. 6 is a flowchart illustrating a method of recording disassembly times applied on the electronic device of FIG. 5. In step S901, the photosensitive element 204' detects the intensity of the ambient light.

In step S902, when the intensity of the ambient light exceeds a predetermined value T2, the photosensitive element 204 generates a trigger signal.

In step S903, the processing element 206 counts a number of disassembly times of the electronic device 100 according to the times the trigger signals have been generated by the photosensitive element 204 and stores the number of disassembly times into the memory 208.

Although the present disclosure has been specifically described on the basis of the embodiments thereof, the disclosure is not to be construed as being limited thereto. Various changes or modifications may be made to the embodiments without departing from the scope and spirit of the disclosure.

What is claimed is:

1. An electronic device, comprising:

a memory;

a photosensitive element for receiving light beams and generating trigger signals when intensity of the received light beams exceeds a predetermined value; and a processing element electrically connected to the photosensitive element and the memory, for counting a number of disassembly times of the electronic device according to the times the trigger signals have been generated by the photosensitive element, and storing the number of disassembly times into the memory.

2. The electronic device as described in claim 1, wherein the processing element increments the number of disassembly times by one when receiving trigger signals from the photosensitive element.

3. A method for recording disassembly times applied on an electronic device which comprises:

a memory;

a photosensitive element; and a processing element, the method comprising:

receiving light beams via the photosensitive element and generating and transmitting trigger signals to the processing element when an intensity of the received light beams exceeds a predetermined value;

recording times the trigger signals have been generated by the photosensitive element; and counting a number of disassembly times according to the times the trigger signals have been generated and storing the number in the memory via the processing element.

4. The method as described in claim 3, wherein counting a number of disassembly times comprises increments the number of disassembly times by one when receiving trigger signals from the photosensitive element.

* * * * *